US006201935B1

(12) United States Patent
Terada et al.

(10) Patent No.: US 6,201,935 B1
(45) Date of Patent: Mar. 13, 2001

(54) ELECTROPHOTOGRAPHIC IMAGE FORMING APPARATUS, ELECTROPHOTOGRAPHIC IMAGE FORMING SYSTEM, AND PROCESS CARTRIDGE

(75) Inventors: Ichiro Terada, Abiko; Shinichi Sasaki, Shizuoka-ken; Isao Ikemoto, Kashiwa; Yoshiya Nomura, Tokyo; Shinya Noda, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/370,907

(22) Filed: Aug. 10, 1999

(30) Foreign Application Priority Data

Aug. 21, 1998 (JP) ..... 10-251935

(51) Int. Cl.[7] ..... G03G 15/00
(52) U.S. Cl. ..... 399/13
(58) Field of Search ..... 399/13, 88, 89, 399/90, 110, 111, 167

(56) References Cited

U.S. PATENT DOCUMENTS

| | | | | |
|---|---|---|---|---|
| 4,933,718 | * | 6/1990 | Furuya | 399/13 |
| 5,151,734 | | 9/1992 | Tsuda et al. . | |
| 5,208,634 | | 5/1993 | Ikemoto et al. . | |
| 5,223,893 | | 6/1993 | Ikemoto et al. . | |
| 5,294,960 | | 3/1994 | Nomura et al. . | |
| 5,331,372 | | 7/1994 | Tsuda et al. . | |
| 5,345,294 | | 9/1994 | Nomura et al. . | |
| 5,404,198 | | 4/1995 | Noda et al. . | |
| 5,463,446 | | 10/1995 | Watanabe et al. . | |
| 5,470,635 | | 11/1995 | Shirai et al. | 428/131 |
| 5,475,470 | | 12/1995 | Sasago et al. . | |
| 5,488,459 | | 1/1996 | Tsuda et al. . | |
| 5,500,714 | | 3/1996 | Yashiro et al. . | |
| 5,510,878 | | 4/1996 | Noda et al. . | |
| 5,543,898 | | 8/1996 | Shishido et al. . | |
| 5,561,504 | | 10/1996 | Watanabe et al. . | |
| 5,583,613 | | 12/1996 | Kobayashi et al. . | |
| 5,602,623 | | 2/1997 | Nishibata et al. | 399/111 |

(List continued on next page.)

FOREIGN PATENT DOCUMENTS

0586042 B1 3/1994 (EP) .

*Primary Examiner*—Sandra Brase
(74) *Attorney, Agent, or Firm*—Fitzpatrick, Cella, Harper & Scinto

(57) ABSTRACT

An electrophotographic image forming apparatus onto which a process cartridge is detachably mountable, for forming an image on a recording medium, has (a) a mounting member for detachably mounting a process cartridge having an electrophotographic photosensitive member, a charging member for charging the electrophotographic photosensitive member, a cartridge charge bias contact for receiving a charging bias to be impressed on the charging member from the main body of the apparatus when the process cartridge is mounted on the main body of the apparatus, and a cartridge-earth contact for connecting the electrophotographic photosensitive member to ground with the main body of the apparatus when the process cartridge is mounted on the main body of the apparatus, (b) a main-body-charge bias contact to be electrically connected to the cartridge-charge-bias contact when the process cartridge is mounted on the mounting member, (c) a main-body earth contact to be electrically connected to the cartridge-earth contact when the process cartridge is mounted on the mounting member, (d) a detecting member for detecting that the process cartridge is not mounted in a cartridge-mounting position by detecting that at least one of the cartridge-charge-bias contact and the cartridge-earth contact is not electrically connected to a corresponding one of the main-body-charge bias contact and the main-body earth contact and (e) a conveying member for conveying the recording medium.

38 Claims, 14 Drawing Sheets

U.S. PATENT DOCUMENTS

| | | | |
|---|---|---|---|
| 5,608,509 | 3/1997 | Shirai et al. | 399/351 |
| 5,617,579 | 4/1997 | Yashiro et al. | 399/114 |
| 5,623,328 | 4/1997 | Tsuda et al. | 399/111 |
| 5,640,650 | 6/1997 | Watanabe et al. | 399/117 |
| 5,689,774 | 11/1997 | Shishido et al. | 399/111 |
| 5,749,027 | 5/1998 | Ikemoto et al. | 399/113 |
| 5,774,766 | 6/1998 | Karakama et al. | 399/111 |
| 5,809,374 | 9/1998 | Tsuda et al. | 399/111 |
| 5,828,928 | 10/1998 | Sasago et al. | 399/111 |
| 5,893,006 * | 4/1999 | Kanno et al. | 399/13 |
| 5,903,803 * | 5/1999 | Kawai et al. | 399/116 |
| 5,909,603 * | 6/1999 | Suzuki et al. | 399/13 |
| 6,029,019 * | 2/2000 | Kawai | 399/13 |
| 6,035,159 * | 3/2000 | Azuma et al. | 399/111 |

* cited by examiner

PRIMARY AC VOLTAGE

PRIMARY CHARGING VOLTAGE

OUTPUT VOLTAGE OF HALF-WAVE RECTIFYING CIRCUIT

ELECTROPHOTOGRAPHIC IMAGE FORMING APPARATUS, ELECTROPHOTOGRAPHIC IMAGE FORMING SYSTEM, AND PROCESS CARTRIDGE

BACKGROUND OF THE INVENTION

1. Field of the Invention

The present invention relates to a process cartridge, an electrophotographic image forming apparatus onto which the process cartridge is detachably mountable, and an electrophotographic image forming system.

Note that the electrophotographic image forming apparatus and system include, for example, an electrophotographic copying machine, an electrophotographic printer (e.g., an LED printer, a laser beam printer, and the like), an electrophotographic facsimile apparatus, an electrophotographic wordprocessor, and the like.

On the other hand, the process cartridges include one that integrates developing means or cleaning means with charging means and an electrophotographic photosensitive member as a cartridge, which is detachably mountable to a main body of the image forming apparatus, one that integrates at least one of the developing means and the cleaning means with the charging means and the electrophotographic photosensitive member as a cartridge, which is detachably mountable to the main body of the image forming apparatus, and furthermore, one that integrates at least the charging means with the electrophotographic photosensitive member as a cartridge, which is detachably mountable to the main body of the image forming apparatus.

2. Related Background Art

Conventionally, an electrophotographic image forming apparatus and an electrophotographic image forming system, which use an electrophotographic image forming process, adopts a process cartridge system, in which an electrophotographic photosensitive member and process means for acting on the electrophotographic photosensitive member are integrated as a cartridge, which is detachably mountable on the main body of the image forming apparatus. According to this process cartridge system, the user himself or herself can maintain the apparatus without the help of a service person, and operability can be greatly improved. For this reason, the process cartridge system is prevalently used in image forming apparatuses.

On the other hand, in this process cartridge system, a demand has arisen for easy operability upon attaching/detaching the process cartridge to/from the main body of the image forming apparatus.

Furthermore, in order to allow easy mounting of the process cartridge on the image forming apparatus, when the cartridge is mounted at a predetermined position, electrical contacts are automatically connected. As an example of such arrangement, an electrical contact arrangement shown in FIG. 17 has been put into practical application. A process cartridge B shown in FIG. 17 has a plurality of electrical contacts. More specifically, the process cartridge B shown in FIG. 17 has a conductive charge contact 120, which is electrically connected to a charging roller shaft (not shown) to impress a charging voltage from the main body of the image forming apparatus to charging means (not shown), a conductive developing contact 121, which is electrically connected to a developing roller (not shown) to impress a developing voltage from the main body of the image forming apparatus to developing means (not shown), and a conductive-toner-remaining-amount detecting contact 122, which is electrically connected to an antenna rod (not shown) to detect the remaining amount of toner. All these three contacts are partially exposed from the bottom surface at one end in a longitudinal direction of the process cartridge B. The three contacts 120 to 122 are separated by distances with which they do not cause electrical leakage. The toner-remaining-amount-detecting contact 122 also serves as a process-cartridge-detecting contact for detecting whether the process cartridge B is mounted on the image forming apparatus.

Furthermore, in order to allow a simple electrical layout of circuit boards, wires, and the like on the main body of the image forming apparatus, a drum-earth contact 23*a* is provided to the same end portion as the three contacts in the longitudinal direction of the process cartridge.

The three contacts are formed by laying a conductive metal plate (e.g., stainless steel, phosphor bronze) having a thickness of about 0.1 mm to 0.3 mm, on the interior of the process cartridge, and the drum earth contact 23*a* is also formed of a conductive member and can be electrically connected to a photosensitive drum via another conductive member (not shown).

Connections between the contacts provided on the process cartridge B and the contacts provided on the image forming apparatus will be explained below. Contact members 124, 125, and 126 of the image forming apparatus are respectively biased by compression coil springs 129, and project upward from holders 127. This structure will be explained taking the charge contact member 124 as an example. The charge contact member 124 is attached inside the holder 127 to be unremovable and projectable upward. The holder 127 is fixed to an electrical circuit board attached to the main body of the image forming apparatus, and the contact member and a wire pattern are electrically connected to each other via the conductive compression coil spring 129. Before the process cartridge B is inserted into the image forming apparatus and reaches a predetermined-mount position, the contact members 124 to 126 are biased upward by the biasing forces of their compression coil springs 129. When the process cartridge B is mounted at the predetermined position, the contacts 120 to 122 of the process cartridge B make the contact members 124 to 126 retract against the biasing forces of the springs 129, thus obtaining a predetermined contact pressure. In this manner, the contacts 120 to 122 of the process cartridge B are brought into contact with the contact members, and can receive various voltages. The image forming apparatus recognizes, based on the toner-remaining-amount detecting contact 122 and the contact member 126, whether the process cartridge B has been mounted.

SUMMARY OF THE INVENTION

The present invention further develops the aforementioned technique.

It is an object of the present invention to provide an image forming apparatus which can detect with higher precision whether a process cartridge is not mounted at a cartridge mount position, an image forming system, and a process cartridge.

It is another object of the present invention to provide an image forming apparatus which also uses a cartridge-charging-bias contact and a cartridge-earth contact as means for detecting whether a process cartridge is not mounted at a cartridge mount position, an image forming system, and a process cartridge.

It is still another object of the present invention to provide an image forming apparatus that can inform a user that a process cartridge is not mounted at a cartridge-mount position when it is detected that at least one of a connection between a cartridge-charging bias contact and a main-body charging bias contact and a connection between a cartridge-earth contact and a main-body earth contact does not achieve an electrical connection, an image forming system, and a process cartridge.

DETAILED DESCRIPTION OF THE PREFERRED EMBODIMENTS

In the following description of the embodiment, the longitudinal direction means a direction perpendicular to a conveying direction of a recording medium, and parallel to a surface of the recording medium. Right or left indicates the conveying direction of the recording medium viewed from the above.

The embodiments of the present invention will be described in detail hereinafter with reference to the drawings. A laser beam printer will be exemplified below as an embodiment of an image forming apparatus.

(First Embodiment)

Figure 1:
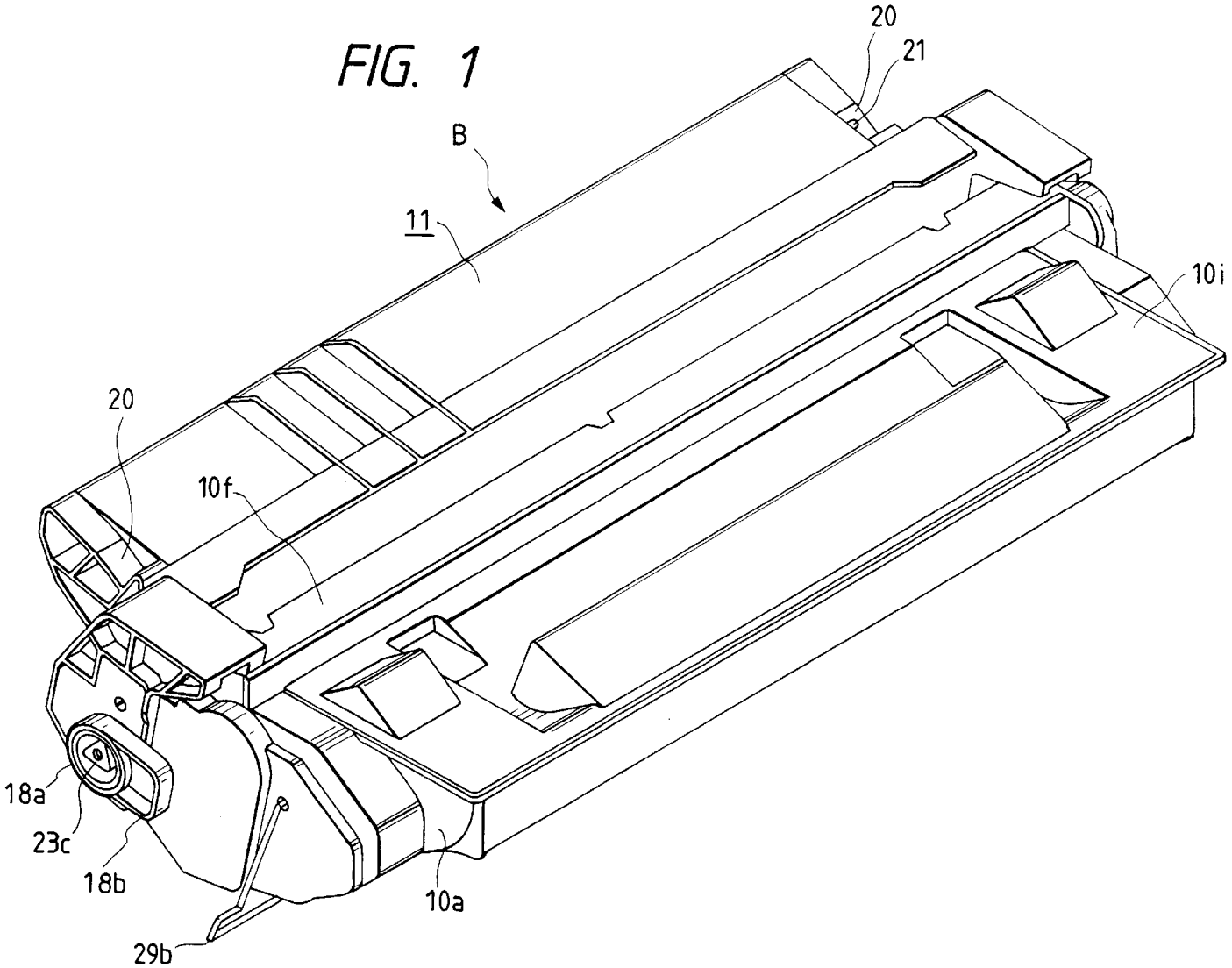
FIG. 1 is a perspective view showing the outer appearance of the outer left side surface of a process cartridge according to an embodiment of the present invention.
Figure 2:
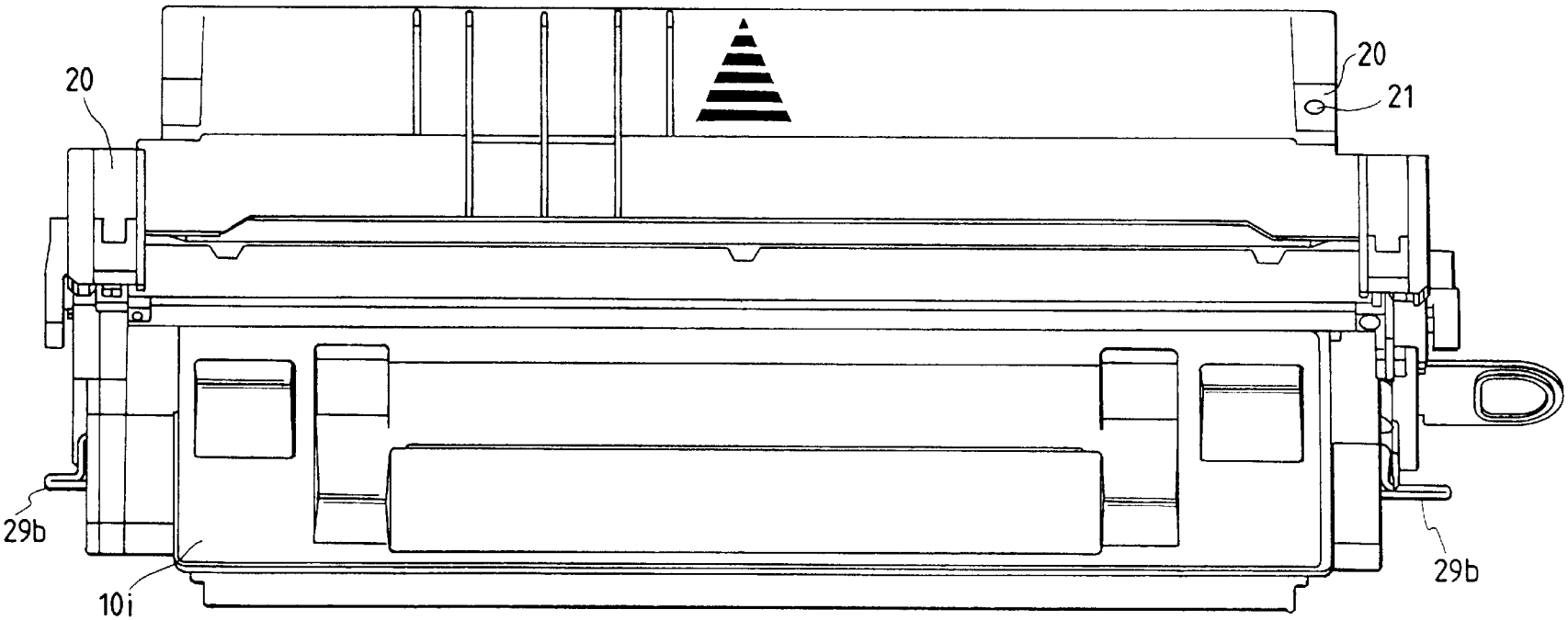
FIG. 2 is a plan view showing the outer appearance of the upper surface of the process cartridge according to the embodiment of the present invention.
Figure 3:
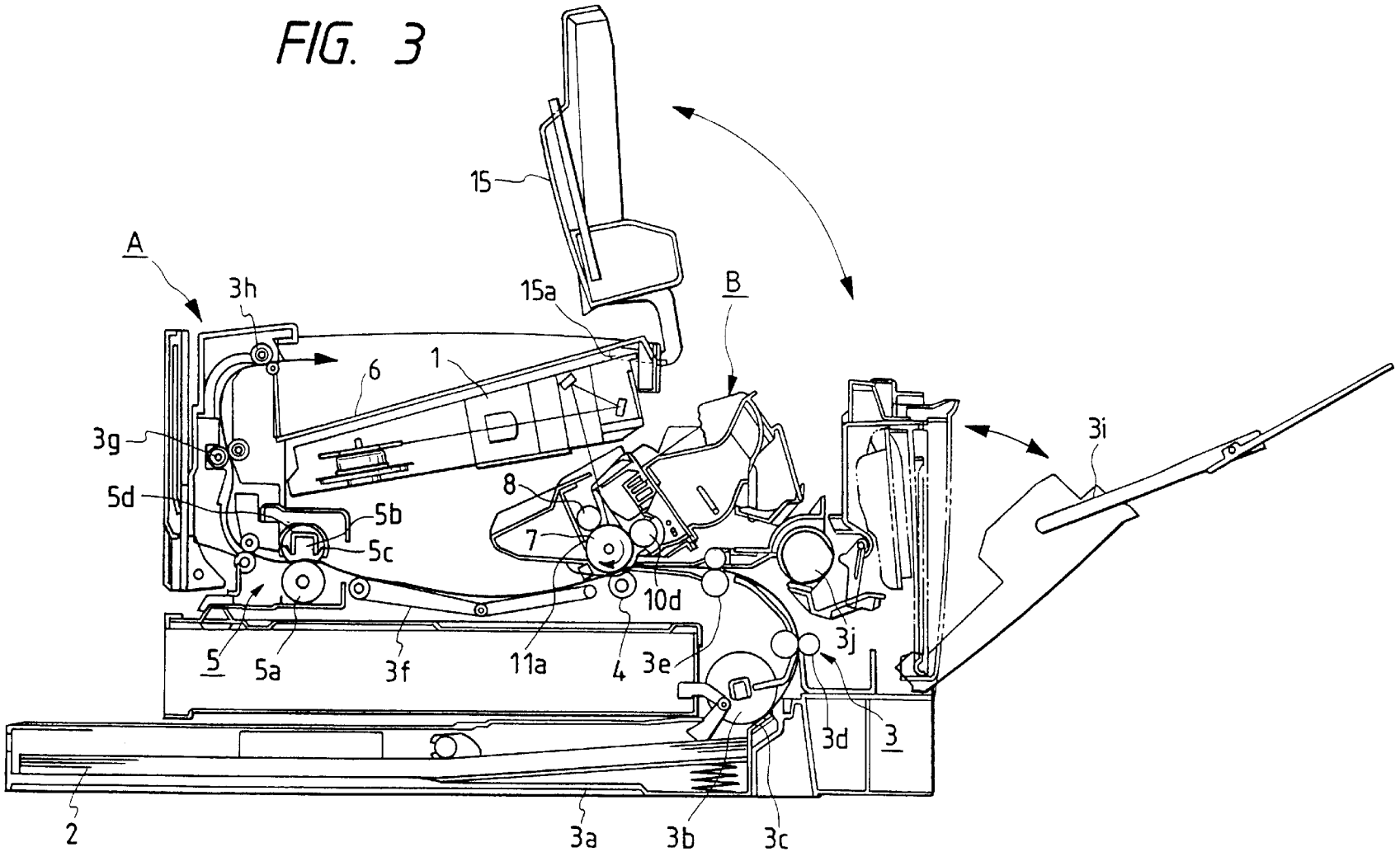
FIG. 3 is a vertical sectional view showing the arrangement of an image forming apparatus and a process cartridge.
Figure 4:
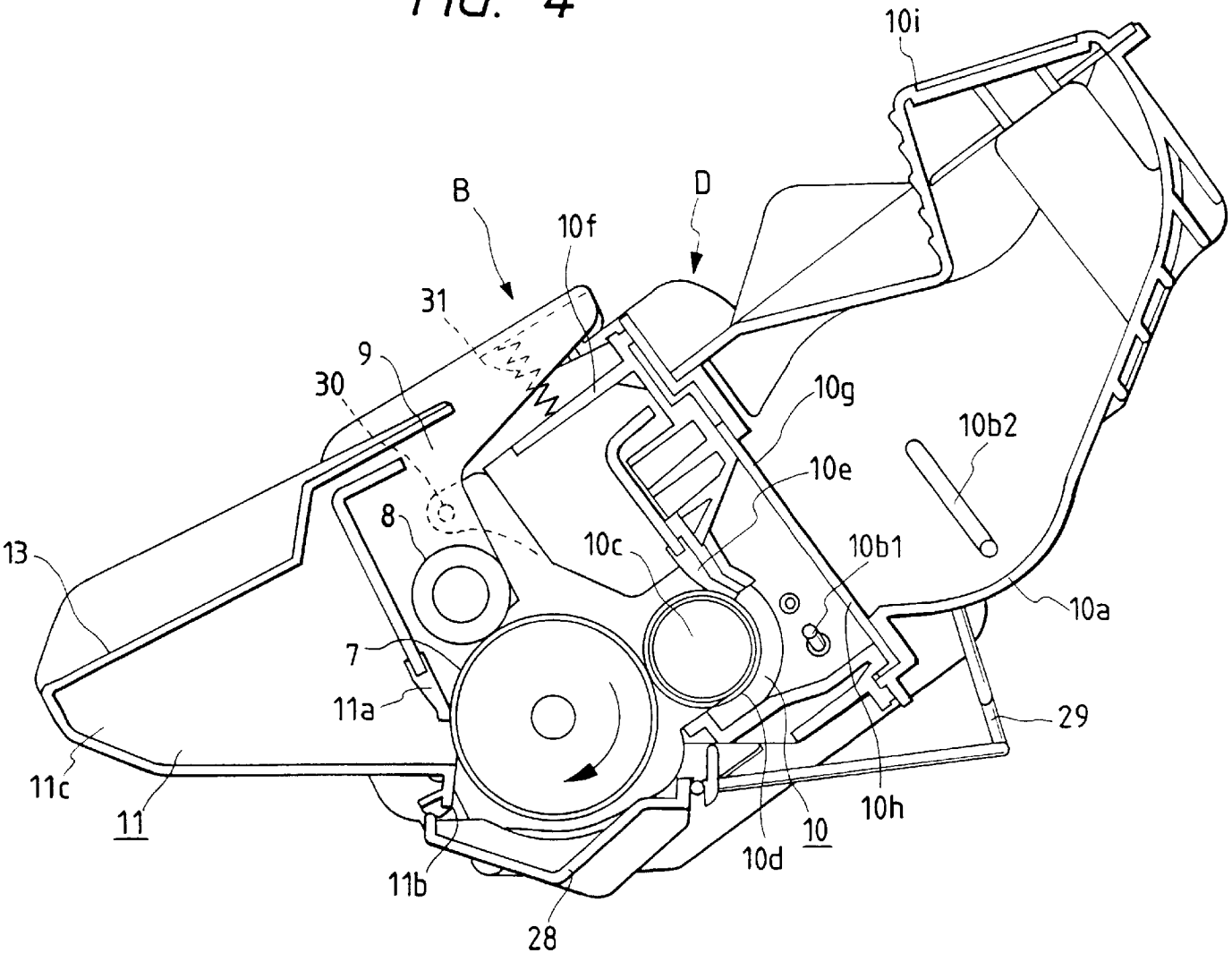
FIG. 4 is a vertical sectional view showing the arrangement of the process cartridge.
Figure 5:
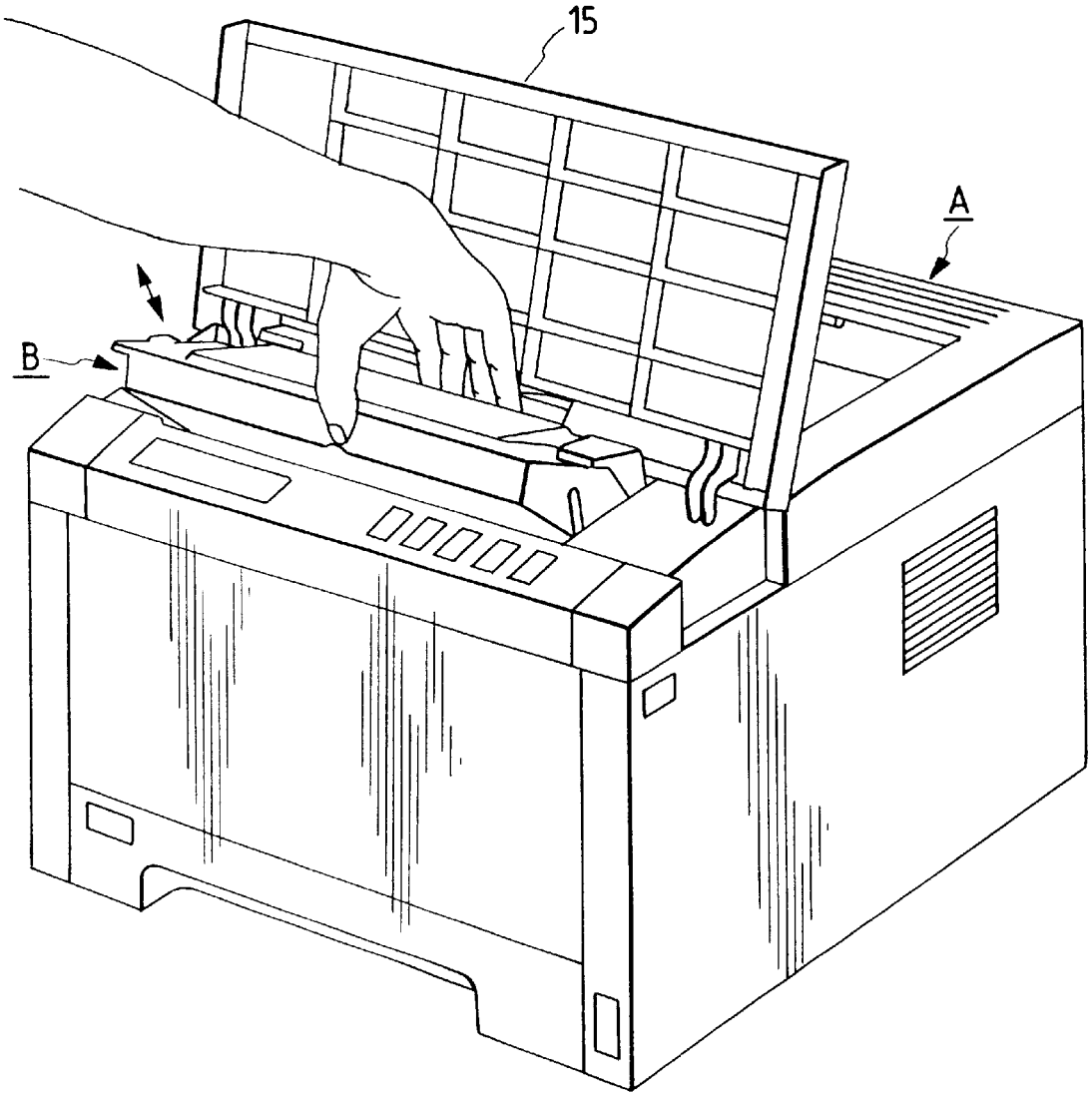
FIG. 5 is a perspective view of the image forming apparatus to explain attachment/detachment of the process cartridge.
Figure 6:
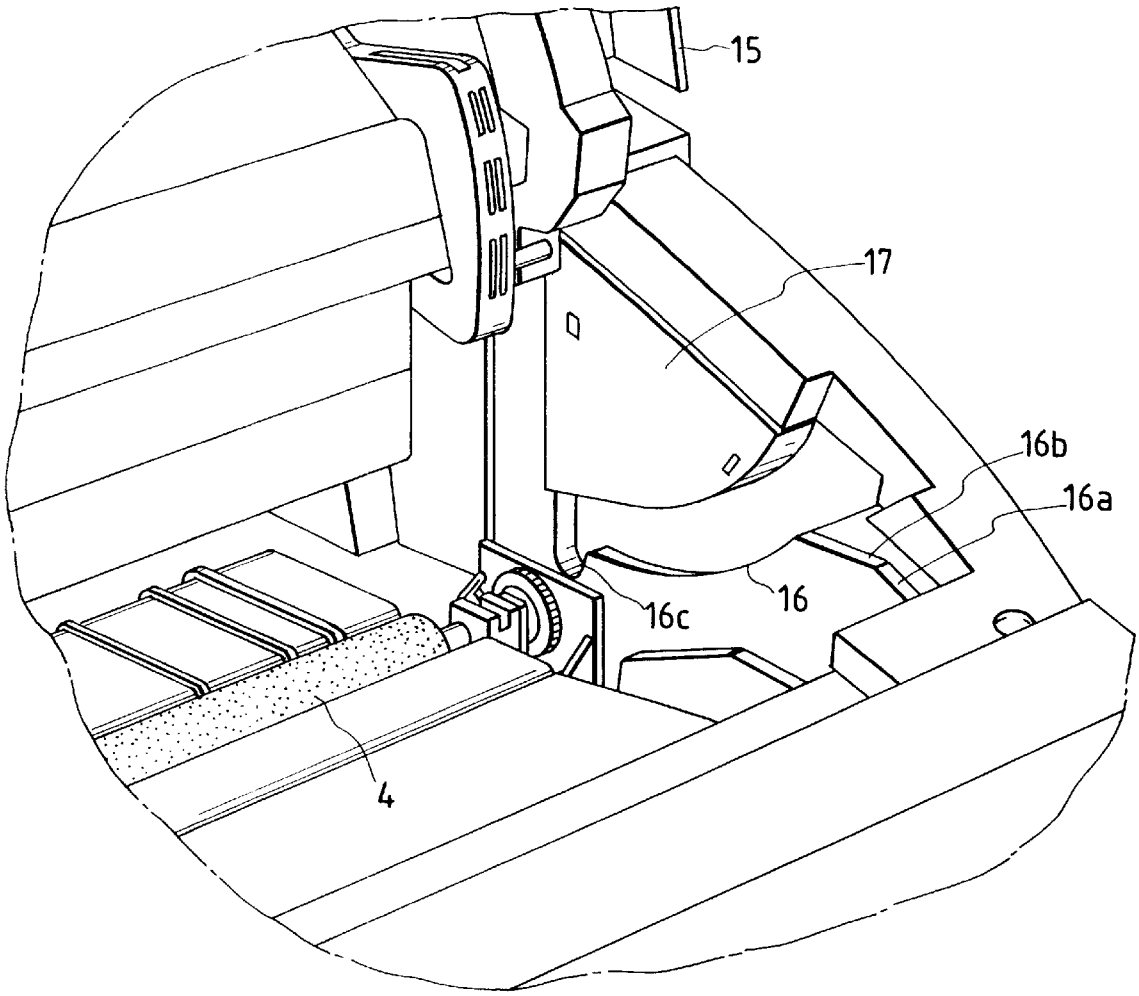
FIG. 6 is a perspective view of a right guide structure of the image forming apparatus, which guides attachment/detachment of the process cartridge.
Figure 7:
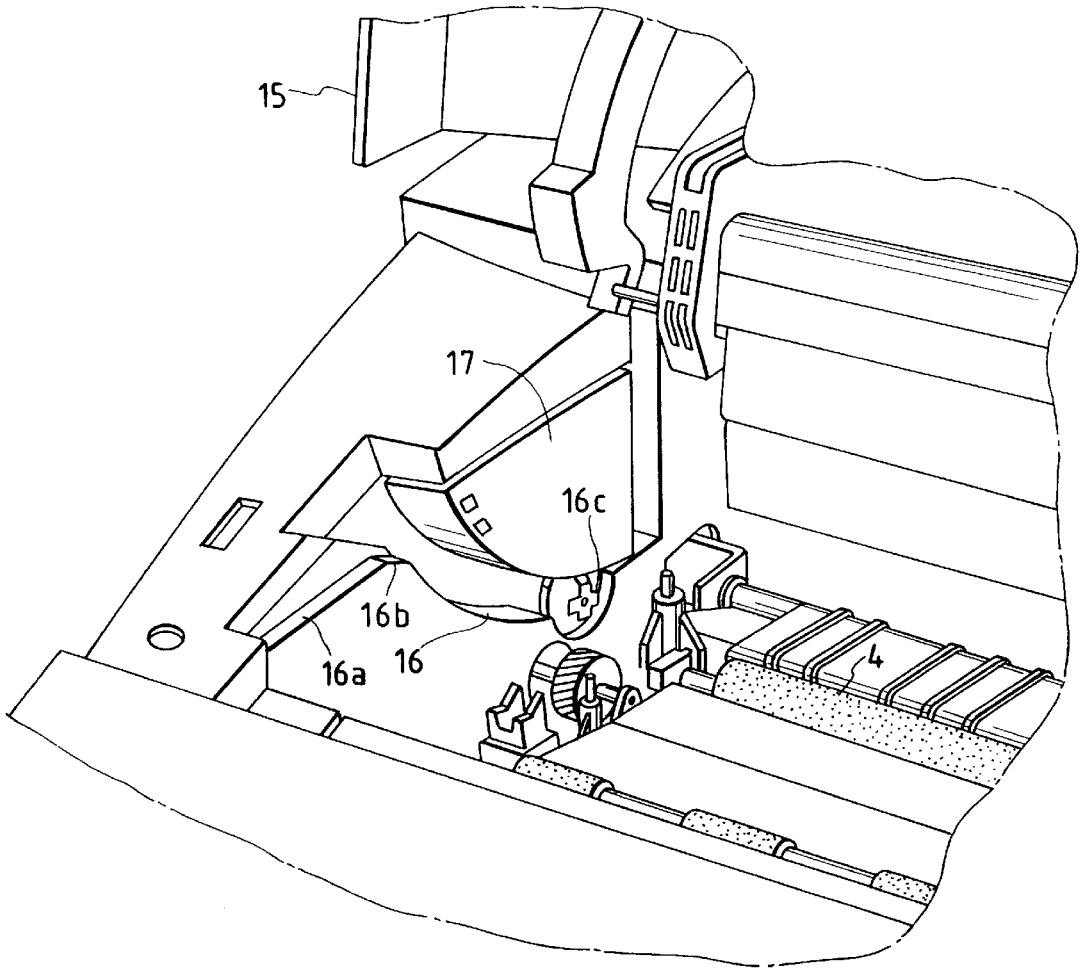
FIG. 7 is a perspective view of a left guide structure of the image forming apparatus, which guides attachment/detachment of the process cartridge.

A process cartridge and an image forming apparatus onto which the process cartridge is detachably mountable will be explained in detail below with reference to FIGS. 1 to 7. Note that FIGS. 1 and 2 are explanatory views of the outer appearance of the process cartridge. FIG. 3 is an explanatory view of the arrangement of the image forming apparatus on which the process cartridge is mounted, FIG. 4 is an explanatory view of the arrangement of the process cartridge, FIGS. 5 to 7 are explanatory views of mount means for a process cartridge B, and FIGS. 8 to 16 are detailed views for explaining the present invention.

The overall arrangement of a process cartridge and an electrophotographic image forming apparatus (electrophotographic image forming system) using the same will be explained first.

An embodiment to be described below is directed to an electrophotographic image forming apparatus that can detach ably mount a process cartridge, and forms an image on a recording medium, comprising: (a) mounting means for detachably mounting a process cartridge having an electrophotographic photosensitive member, charging means for charging the electrophotographic photosensitive member, a charge contact at which the charging means receives a charging voltage from a high-voltage power supply of a main body of the image forming apparatus, and a drum-earth contact for connecting the electrophotographic photosensitive member to ground; (b) a main-body charge contact connected to the charge contact of the process cartridge when the process cartridge is mounted; (c) a main-body earth contact connected to the earth contact of the process cartridge when the process cartridge is mounted; (d) process-cartridge-mounting-state detecting means for detecting that the process cartridge is mounted when the charge contact and the earth contact of the process cartridge are respectively connected to the those of the main body of the apparatus, and detecting the absence or mounting failure of the process cartridge when one of the contact portions is not connected; and (e) conveying means for conveying a recording medium.

[Overall Arrangement]

As shown in FIG. 3, an electrophotographic image forming apparatus (laser beam printer) A forms a latent image on a photosensitive drum 7 as a drum-shaped electrophotographic photosensitive member by irradiating the photosensitive drum 7 with information light based on image information from an optical system 1, and develops the latent image with developer (to be referred to as "toner" hereinafter) to form a toner image. In synchronism with formation of the toner image, a recording medium 2 is fed one by one from a sheet feeding cassette 3*a* that stores recording media 2 via a pickup roller 3*b* and a pressure-contacting member 3*c*, which is in pressure contact, with the pickup roller 3*b*, and is conveyed by conveying means 3, consisting of a pair of conveying rollers 3*d*, a pair of registration rollers 3*e*, and the like. The toner image formed on the electrophotographic photosensitive member included in a process cartridge B is then transferred onto the recording medium 2 by impressing a voltage to a transfer roller 4 serving as transferring means, and the recording medium 2 is conveyed to fixing means 5 via a conveying belt 3*f*. The fixing means 5 comprises a driving roller 5*a* and a fixing rotary member 5*d,* which incorporates a heater 5*b,* and which is formed of a cylindrical sheet rotatably supported by a supporting member 5*c*. The fixing means 5 fixes the transferred toner image by applying heat and pressure to the recording medium 2, which is passing by the fixing means 5. The recording medium 2 is conveyed by pairs of discharging rollers 3*g* and 3*h,* and is discharged onto a discharging portion 6 via a surface-reverse-conveying path. Note that a recording medium 2 can also be fed by a manual inserting tray 3*i* and roller 3*j* in this image forming apparatus (image forming system) A.

[Process Cartridge]

On the other hand, the process cartridge B comprises an electrophotographic photosensitive member and at least one process means. Note that the process means includes, for example, charging means for charging the electrophotographic photosensitive member, developing means for developing a latent image formed on the electrophotographic photosensitive member, cleaning means for cleaning residual toner on the surface of the electrophotographic photosensitive member, and the like. The process cartridge B of this embodiment has an arrangement shown in FIG. 4. That is, the photosensitive drum 7 as an electrophotographic photosensitive member having a photosensitive layer is rotated, a voltage is impressed to a charging roller 8 serving as charging means to uniformly charge the surface of the photosensitive drum 7, the charged photosensitive drum 7 is exposed with an optical image from the optical system 1 via an exposure opening 9 to form a latent image, and the latent image is developed by developing means 10.

The developing means 10 feeds toner to an opening 10*g* of a toner containing frame 10*a* by a rotational toner feeding member 10*b*2 as toner feeding means in the toner containing frame 10*a,* then feeds the toner into a toner developing frame 10*f* via an opening 10*h* of the toner developing frame 10*f,* and agitates the toner by a toner agitating member 10*b*1. A developing roller 10*d* as a developing rotary member that incorporates a stationary magnet 10*c* is rotated to form a toner layer given with a triboelectric charge on the surface of the developing roller 10*d* by using a developing blade 10*e*. The developing means 10 then transfers the toner onto the photosensitive drum 7 in accordance with the latent image, thus visualizing the latent image, i.e., forming a toner image.

After the toner image is transferred onto the recording medium 2 by impressing a voltage with a polarity opposite to that of the toner image to the transfer roller 4, the residual toner on the photosensitive drum 7 is removed by cleaning means 11, which scrapes off the residual toner by a cleaning blade 11*a,* dips the toner by a dip sheet 11*b,* and collects the toner in a waste-toner containing portion 11*c*.

Note that the respective members, such as the photosensitive drum 7 and the like, are housed in a cartridge frame constructed by coupling: a developing unit D, which is integrated by welding the toner containing frame 10*a* for rotatably supporting the toner feeding member 10*b*2, the toner developing frame 10*f* that incorporates developing members such as the toner agitating member 10*b*1, the developing roller 10*d,* the developing blade 10*e,* and the like, and a lid member 10*i;* and a cleaning frame 13 which forms the waste-toner-containing portion 11*c* and has the photosensitive drum 7, the cleaning blade 11*a,* the dip sheet 11*b,* and the charging roller 8, so as to build a cartridge, in which the cartridge is detachably mountable on cartridge mounting means provided in the image forming apparatus A.

The developing unit D and the cleaning frame 13 are coupled by pivotally coupling the toner developing frame 10*f* and the cleaning frame 13 via a shaft 29, and by inserting a compression coil spring 31 between the toner developing frame 10*f* and the cleaning frame 13 in a biased state to produce a moment about a shaft 30 so as to bring the photosensitive drum 7 into pressure contact with space rollers that are provided to the two ends of the developing roller 10*d* and have a diameter slightly larger than that of the developing roller 10*d*.

[Attachment/detachment Arrangement of Process Cartridge]

An arrangement for attaching/detaching the process cartridge B to/from the image forming apparatus A will be explained below.

The process cartridge B is attached/detached by opening a cover 15, as shown in FIG. 5. As the cartridge mounting means, upon opening the cover 15 about a shaft 15*a* (see FIG. 3), guide rails 16, which have a descending, downward convex curved shape (nearly an arcuated shape in this embodiment), are nearly symmetrically formed on the right and left side surfaces of a cartridge-mounting space, and guide members 17 are attached above these guide rails 16, as shown in FIGS. 6 and 7. Furthermore, a first slope surface 16*a* and a second slope surface 16*b* having a larger slope than the first slope surface 16*a* are formed at the entrance of each guide rail 16 to serve as a hook portion that engages with the abutment portion 29*b* (see FIGS. 1 and 2) for opening a shutter 28 of the process cartridge B.

Guide portions, which are guided along the guide rails 16, are formed on the two end faces in the longitudinal direction of the process cartridge B in correspondence with the guide rails 16. These guide portions project from nearly symmetrical positions (FIG. 1 illustrates the left end face, but the right end face is not shown) on the two end faces in the longitudinal direction of the cartridge frame, and each guide portion is formed by integrating a boss 18*a* serving as a first guide portion and a rib 18*b* serving as a second guide portion, as shown in FIG. 1. The boss 18*a* is located on the extending axis of the rotation shaft of the photosensitive drum 7, and the rib 18*b* is contiguous with the boss 18*a* and extends in a downward convex curved shape (nearly an arcuated shape in this embodiment) in correspondence with the shape of the guide rail 16 along the insertion direction of the process cartridge B.

Figure 8:
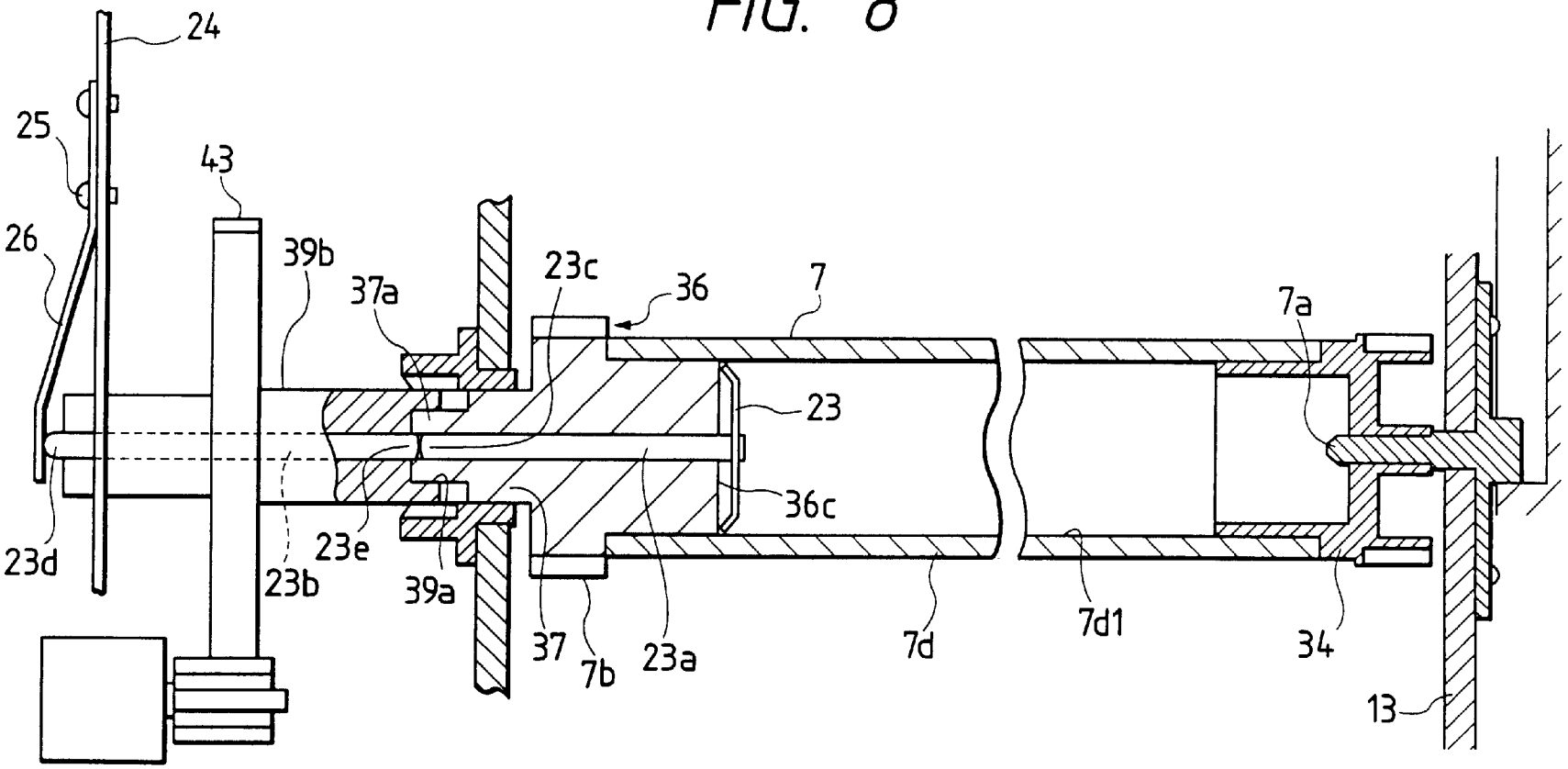
FIG. 8 is a vertical sectional view of a contact portion to explain a drum earth contact according to the embodiment of the present invention.

In the above arrangement, when the process cartridge B is mounted, the process cartridge B is inserted so that its leading end slips under the optical system 1 of the image forming apparatus A while setting the bosses 18*a* and the ribs 18*b* along the guide rails 16. Since the guide rails 16 are formed into nearly an arcuated shape, the guide members 17 attached thereabove also have a shape that follows that of the guide rails, and the ribs 18*b* similarly have nearly an arcuated shape, and the process cartridge B becomes nearly horizontal as it is inserted. When the process cartridge B is further pushed into the apparatus, abutment members 19 (see FIG. 9) formed on the image forming apparatus A abut against abutment surfaces 20 formed near the two end portions of the leading end of the cleaning frame 13, and the bosses 18*a* of the process cartridge B then drop into receiving recess portions 16*c* formed at the terminal ends of the guide rails 16. In this manner, a drum flange 36, fixed to one end of the photosensitive drum 7, engages with a coupling recessed shaft 39*b* of the main body of the image forming apparatus A, so that the driving force can be transmitted to the process cartridge B, as shown in FIG. 8.

[Arrangement and Operation of Earth Contact Portion]

The arrangement and operation of the earth-contact portion will be explained below. The photosensitive drum 7 is connected to ground with respect to the main body of the image forming apparatus A. As shown in FIG. 8, a drum flange 34 of the photosensitive drum 7 is fitted and fixed into the non-driven end of a drum cylinder 7*d*, and is rotatably supported by a drum shaft 7*a* fixed to the cleaning frame 13. Since the drum shaft 7*a* of this embodiment is not used for ground, its material is not limited to a metal but may be an insulating synthetic resin.

An earth contact 23*a* is axially and movably fitted into a center hole of the drum flange 36, which is fixed to the driving end of the cylinder 7*d*. This earth contact 23*a* has a rod shape, one end of which is fitted into an earth plate 23 contacting an inner end face 36*c* of the drum flange 36, and is fixed by caulking. This earth plate has a projection on its end portion. The distal end of the projection is slightly bent toward the driving end, and is elastically pushed into an inner surface 7*d*1 of the drum cylinder 7*d*.

A main-body earth contact member 23*b* is fitted and fixed into the center of the coupling recessed shaft 39*b*. One end of the main-body earth contact member 23*b* is a main-body earth terminal 23*e*, which can contact a terminal 23*c* of the process cartridge B, and a sliding terminal 23*d* at the other end thereof is in pressure contact with the distal end of a leaf spring 26, which is fixed to an iron side plate 24 of the image forming apparatus A by small screws 25. The main-body earth terminal 23*e* projects from the bottom surface of a recessed portion 39*a* to allow easy maintenance. The leaf spring 26 is formed of a conductive material, such as spring steel, stainless steel, phosphor bronze, beryllium, a bronze plate, or the like.

A coupling recessed shaft 39*b*, which is formed integrally with a large gear 43, extends in the axial direction of a coupling projecting shaft 37, which is formed integrally with a drum gear 7*b*. When the cover 15 is closed while the process cartridge B is mounted on the image forming apparatus A, the coupling recessed shaft 39*b* moves toward the coupling projecting shaft 37, and the recessed portion 39*a* engages with a projecting portion 37*a* directly or at the beginning of rotation of the coupling recessed shaft 39*b*. Before the end face of the projecting portion 37*a* contacts the bottom surface of the recessed portion 39*a*, the earth terminal 23*c* of the process cartridge B contacts the earth terminal 23*e* of the image forming apparatus A. Furthermore, the coupling recessed shaft 39*b* and the earth contact member 23*b* move forward by the biasing force of a compression coil spring (not shown), which biases the coupling recessed shaft 39*b* toward the projecting shaft 37, against the biasing force of the earth plate 23, and the bottom surface of the coupling recessed portion 39*a* comes into contact with the end face of the projecting portion 37*a*. Upon movement of the sliding terminal 23*d* following forward movement of the coupling recessed shaft 39*b*, the leaf spring 26 follows the sliding terminal 23*d* to be in pressure contact with the sliding terminal 23*d* by the biasing force.

(Arrangement of Charge Contact Portion)

Figure 9:
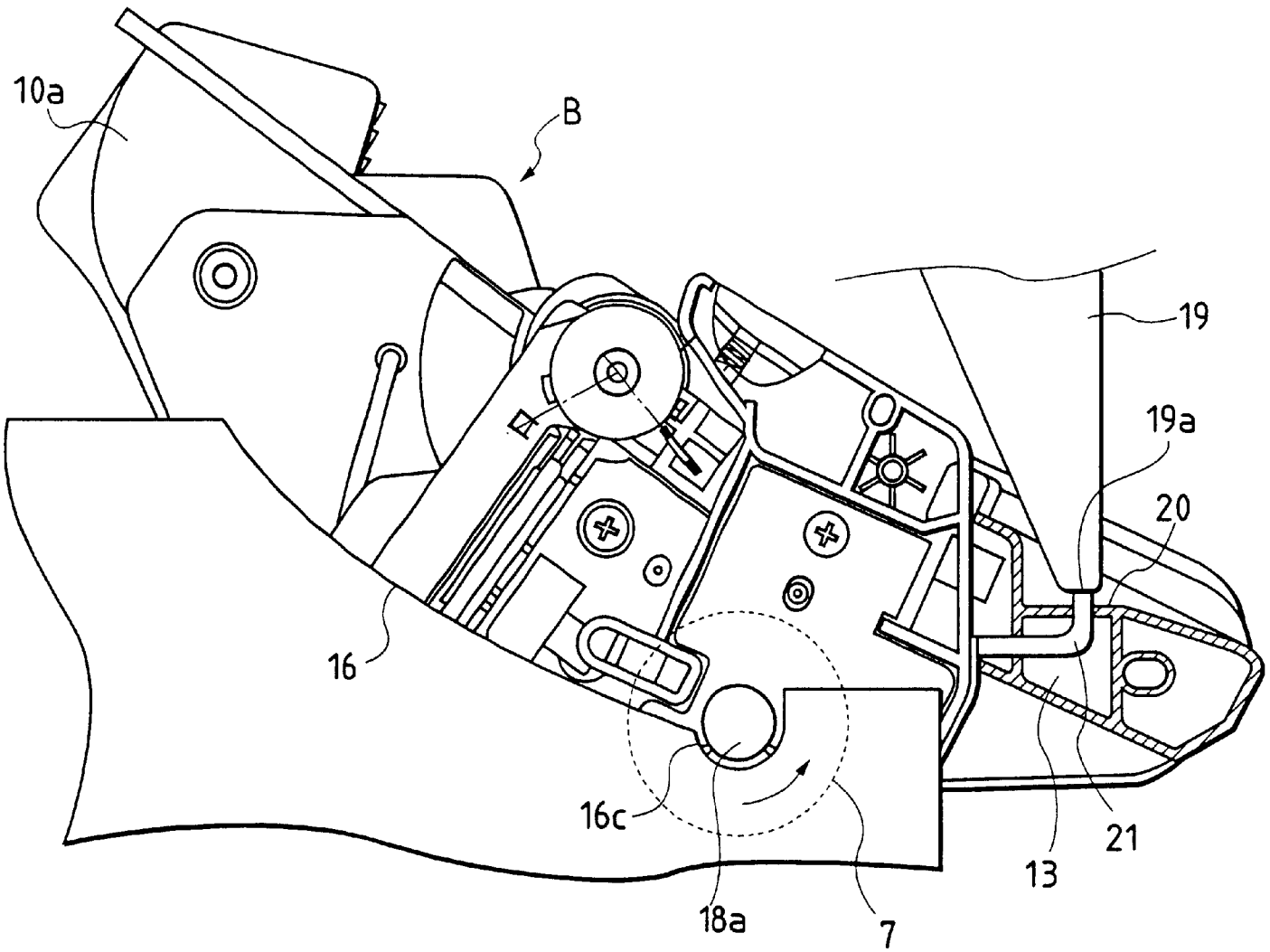
FIG. 9 is a side view of the outer appearance of the side surface to explain an electrode contact portion according to the embodiment of the present invention.
Figure 10:
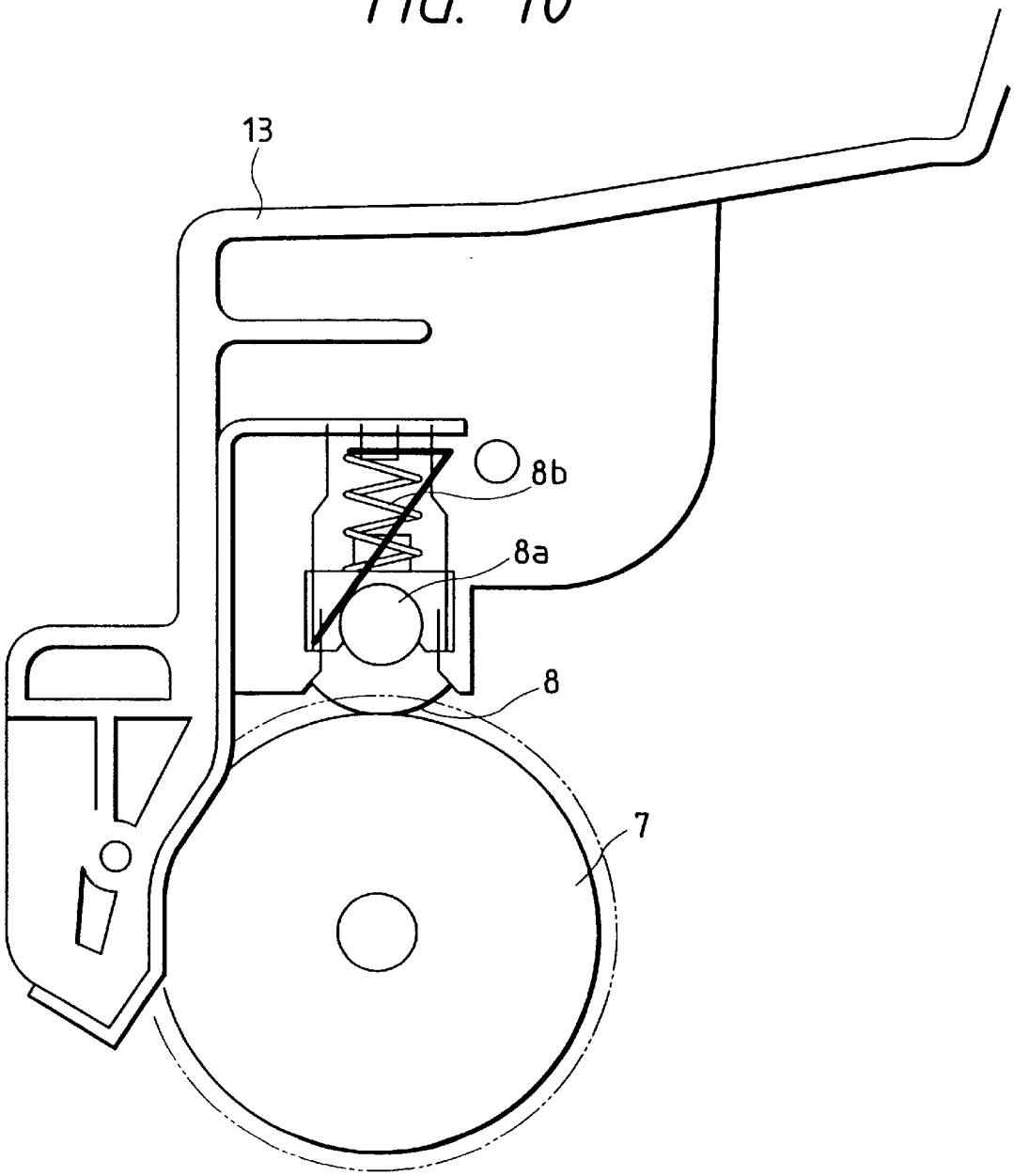
FIG. 10 is a vertical sectional view for explaining a charging roller according to the embodiment of the present invention.

The arrangement of the charge contact portion will be explained below. A charge contact 21 is partially exposed from the right end side of the upper portion of the process cartridge B as abutment surface 20, as shown in FIG. 9. The charge contact 21 is stretched around the cleaning frame 13 to electrically contact a shaft 8*a* of the charging roller 8 via a compound spring 8*b*, which contacts the charging roller shaft 8*a* (FIG. 10). The abutment member 19 provided in the image forming apparatus A is located on the side opposite to the earth contact in the longitudinal direction of the process cartridge B. The abutment member 19 has an electrode 19*a* for supplying a charging voltage to the charging roller 8, and the electrode 19*a*, which serves as a charge contact of the main body of the apparatus, receives a charging voltage from a AC high-voltage amplifying circuit (not shown). When the process cartridge B is inserted into the image forming apparatus A, the charge contact 21 and the abutment member 19 electrically contact each other, and impress the charging voltage to the charging roller 8. Note that the charge contact 21 is flush with the abutment surface 20. When the charge contact 21 projects from the abutment surface 20, as shown in FIG. 9, the posture of the process cartridge B is determined by only a contact between the charge contact 21 and the abutment member 19, which does not contact the abutment surface 20. Note that the abutment surface 20 on the right side of the process cartridge B is a base material surface of the lid member 10*i*.

As described above, when electrical detecting means of the process cartridge B are respectively connected to the earth contact 23*a* of the photosensitive drum 7 and the electrode 19*a* of the charging means, and both the contacts detect that the process cartridge B is mounted, electrical connection errors and defective images, due to malfunctions of the image forming apparatus A, can be prevented, and a low-cost detecting device can be constructed since detection is electrically done.

Figure 11:
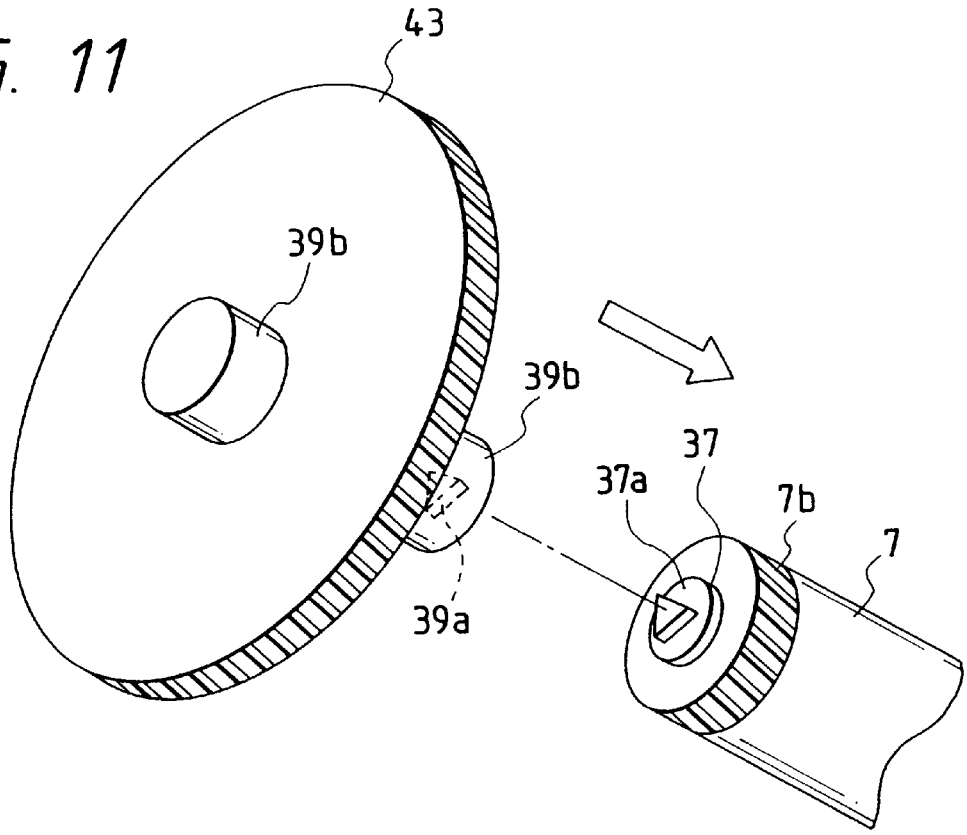
FIG. 11 is a perspective view of a coupling provided to the main body of the apparatus and a coupling provided to the process cartridge according to the embodiment of the present invention.
Figure 12:
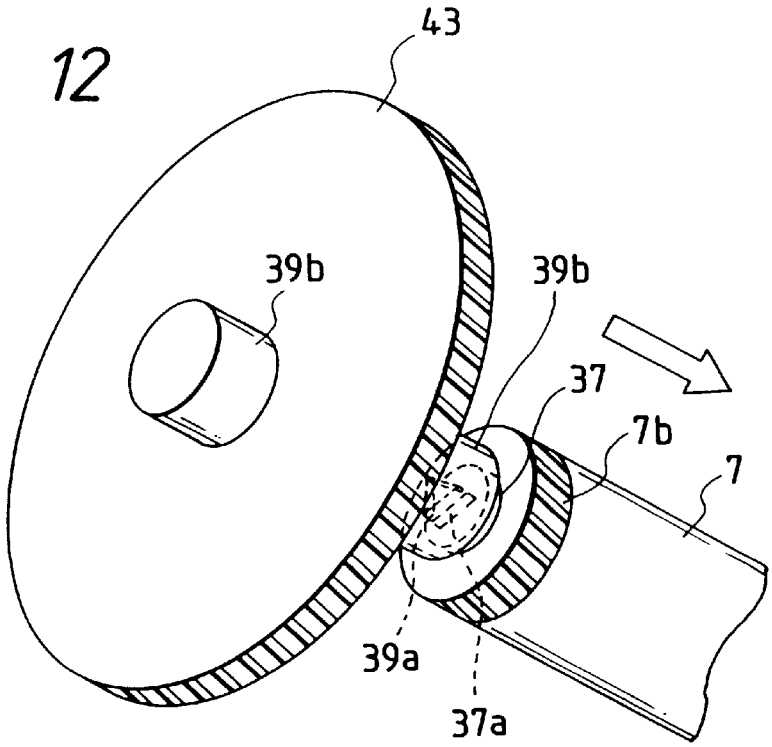
FIG. 12 is a perspective view of a coupling provided to the main body of the apparatus and a coupling provided to the process cartridge according to the embodiment of the present invention.

FIG. 11 is a detailed view of the large gear 43 provided in the image forming apparatus A and the photosensitive drum 7 provided in the process cartridge B. The coupling recessed shaft 39*b* formed integrally with the large gear 43 has the recessed portion 39*a* at its distal end. The recessed portion 39*a* has a twisted-hole having a triangular cross-section. On the other hand, the drum gear 7*b* is provided on the end portion of the photosensitive drum 7. The coupling projecting shaft 37 and the coupling projecting portion 37*a* are formed integrally with the drum gear 7*b*. The coupling projecting portion 37*a* has the shape of a twisted-triangular prism, and when the process cartridge B is inserted into the image forming apparatus A, the large gear 43 and the photosensitive drum 7 are coupled to each other, as shown in FIG. 12, since they are coaxial. When the coupling recessed shaft 39*b* rotates in this state, the inner surface of the coupling recessed portion 39*a* contacts the ridges of three points of the triangular prism of the coupling projecting portion 37*a*, thus transmitting the rotational driving force. At this time, the coupling projecting shaft 37 instantaneously moves to agree with the center of the coupling recessed shaft 39*b*, and the coupling projecting shaft 37 and the coupling recessed shaft 39*b* are automatically centered, so that the inner surface of the coupling recessed portion 39*a* equally contacts the ridges of the coupling projecting portion 37*a*. Since the twist directions of the projecting portion 37*a* and the recessed portion 39*a* are set so that their contact portions draw closer to each other upon rotation, the coupling projecting shaft 37 and coupling recessed shaft 39*b* draw closer to each other. In this manner, since the earth contact 23*a* can reliably contact the main-body earth contact member 23*b* by the automatic centering mechanism and the drawing force, mounting of the process cartridge can be detected with higher precision.

As described above, according to this embodiment, the coupling portion of the large gear 43 as a rotary member has a twisted hole having a polygonal cross-section, and the coupling portion of the electrophotographic photosensitive drum 7 has a shape of a twisted-polygonal prism. That is, the electrophotographic photosensitive drum 7 has its coupling portion on a center axis of the electrophotographic photosensitive drum 7 for receiving the driving force from the coupling portion of the large gear 43 as a rotary member of the main body of the image forming apparatus, on its central line, and the coupling portion of the electrophotographic photosensitive drum 7 has a shape of a twisted-polygonal prism, and the coupling portion of the large gear 43 has a twisted hole having a polygonal cross-section. Or the coupling portion of the large gear 43 as a rotary member may have a shape of a twisted-polygonal prism, and the coupling portion of the electrophotographic photosensitive drum 7 may have a twisted hole having a polygonal cross-section.

Note that a coupling-projecting portion having a twisted-polygonal-prism shape, e.g., twisted-triangular prism shape, may be formed integrally with the large gear 43, and a coupling recessed portion having a twisted hole having a polygonal, e.g., triangular cross-section, which is to be engaged with the coupling projecting portion, may be formed integrally with the drum gear 7*b*. With this structure, since the automatic centering mechanism and drawing force can be obtained at the coupling portion, the same effect as in the above embodiment can be obtained.

Figure 13:
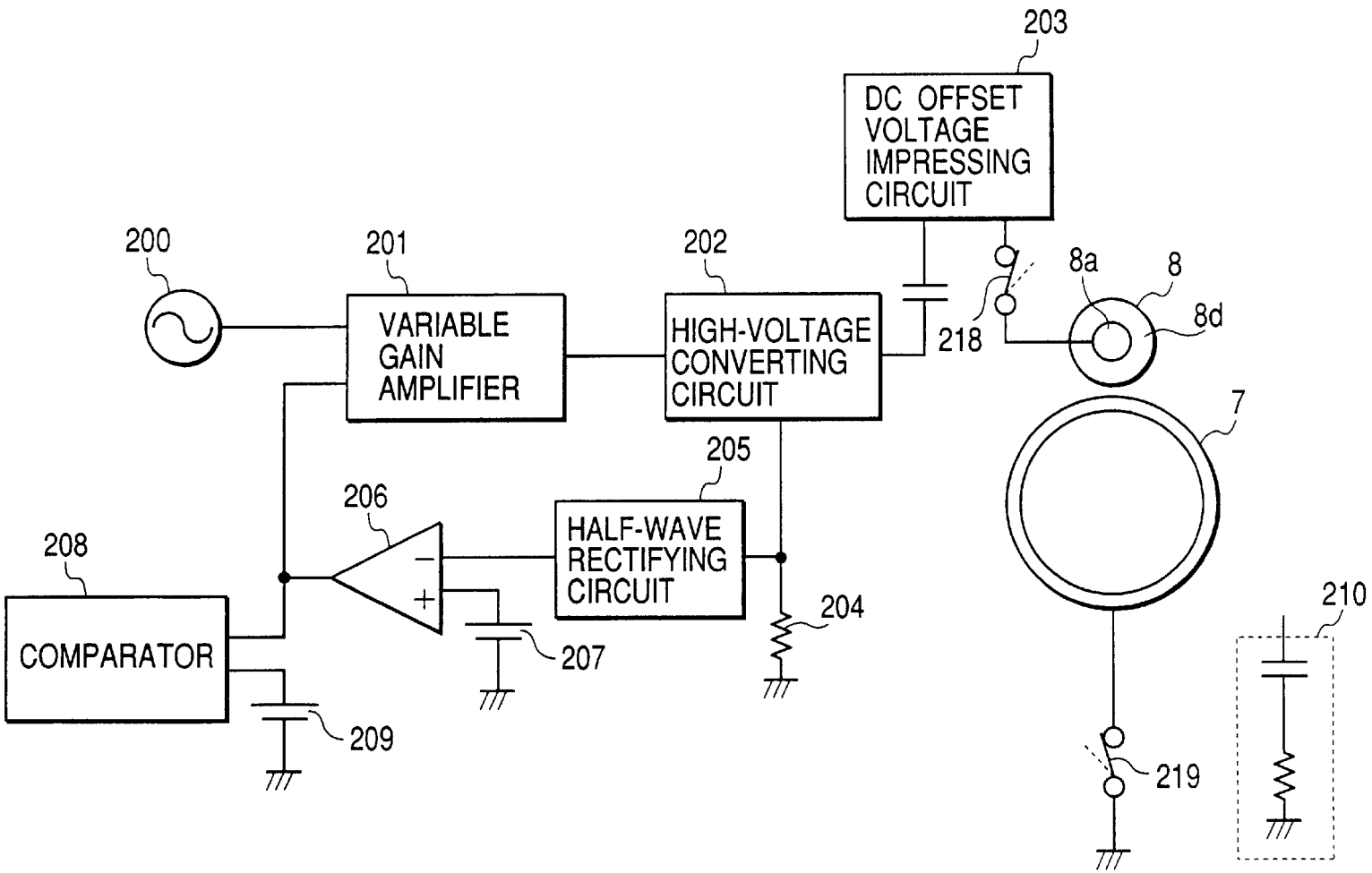
FIG. 13 is an electrical control block diagram for explaining the embodiment of the present invention.

FIG. 13 is a block diagram of a detecting device that can detect mounting of the process cartridge B when both the earth-contact portions and the electrode-contact portions are connected. In this embodiment, the charging roller that uses a conductive resistor is used as the charging means, and detecting means of this embodiment is the detecting device of the charging means in the process cartridge in the electrophotographic apparatus using the charging roller.

Figure 14:
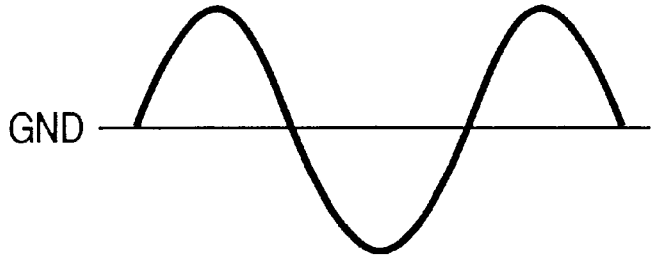
FIG. 14 is an operation waveform chart for explaining the operation of the embodiment of the present invention.

Referring to FIG. 13, a reference voltage generating device 200 generates an AC voltage having a predetermined period shown in FIG. 14.

A variable-gain amplifier 201 as a variable amplitude generator changes its gain in accordance with an output voltage fed back from a differential amplifier (to be described later). A high-voltage converting circuit 202 serves as AC high-voltage amplifying circuit for converting the AC voltage received from the variable gain amplifier 201 into an AC high voltage. A DC offset voltage impressing circuit 203 impresses a constant voltage.

Figure 15:
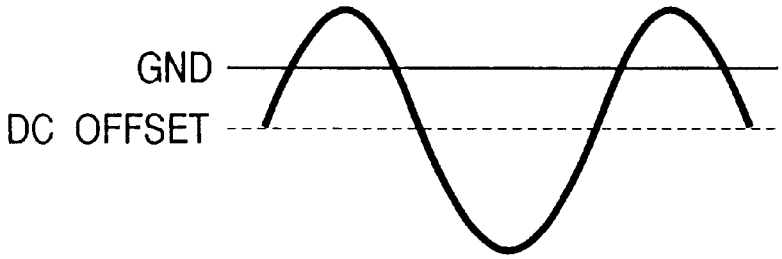
FIG. 15 is an operation waveform chart for explaining the operation of the embodiment of the present invention.

The charging roller 8 receives a voltage waveform shown in FIG. 15, which is obtained by superposing the output from the DC-offset voltage impressing circuit 203 on the output from the high-voltage converting circuit 202. The charging roller 8 is formed by the charging-roller shaft 8*a* and a sponge resistor 8*d*. The photosensitive drum 7 is formed by a conductor portion and a photosensitive member.

Figure 16:
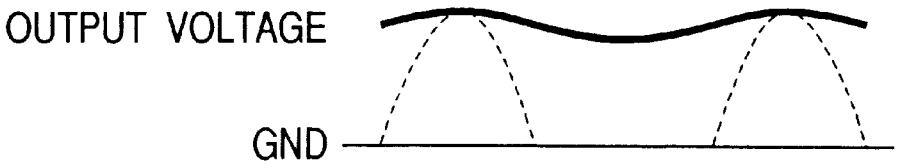
FIG. 16 is an operation waveform chart for explaining the operation of the embodiment of the present invention.
Figure 17:
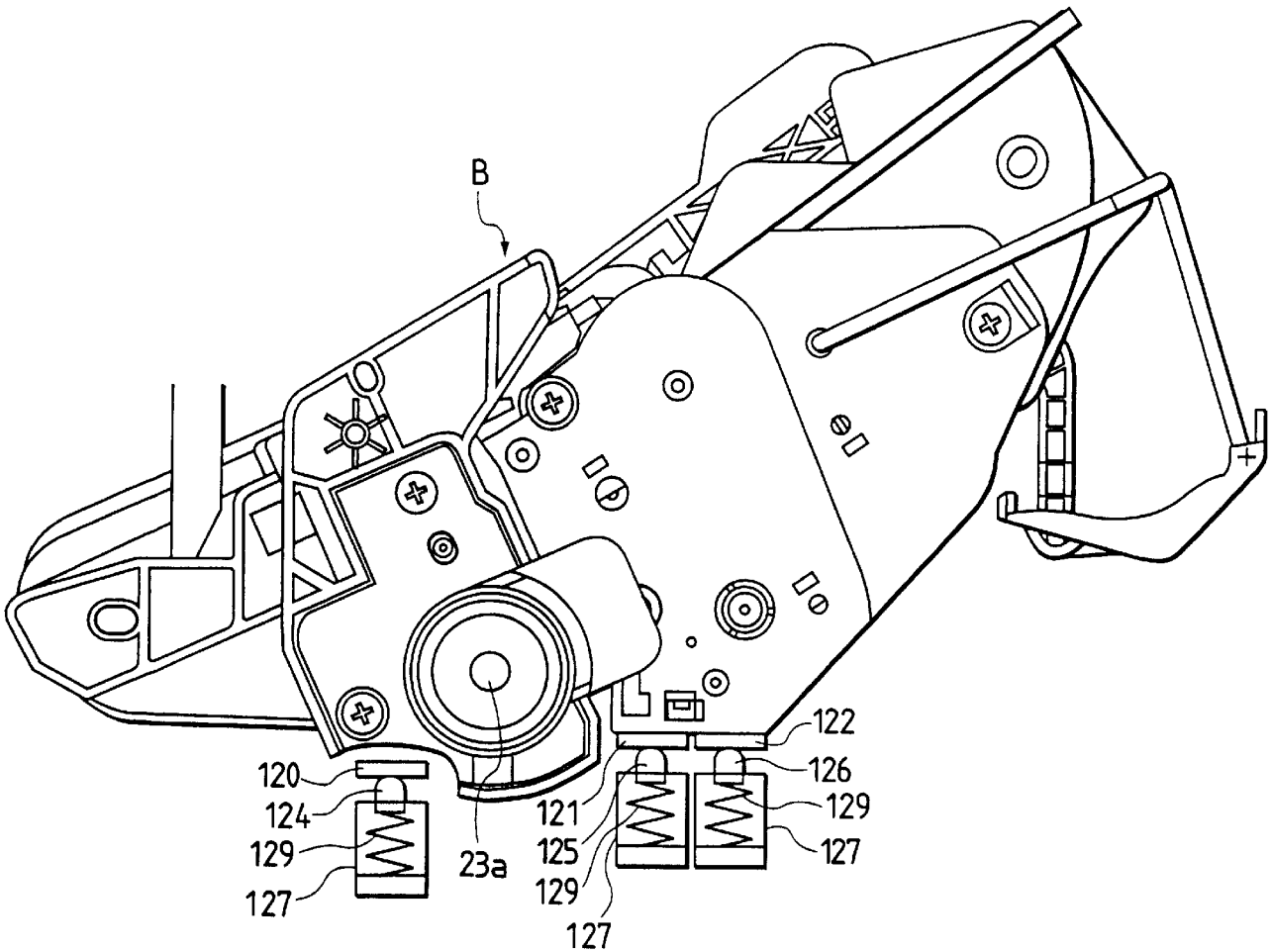
FIG. 17 PRIOR ART
FIG. 17 is a side view for explaining the prior art.

An electric-current rectifying resistance 204 serves as an electric-current detecting circuit for detecting an electric current that flows through the high-voltage converting circuit 202 as a voltage value. A half-wave rectifying circuit 205 rectifies an input AC voltage, as shown in FIG. 16, and outputs a peak value or an effective value. A differential amplifier 206 outputs a difference between the output from the half-wave rectifying circuit 205 and a reference voltage 207. A comparator 208 compares the output voltage from the differential amplifier 206 and a reference voltage 209, and the presence/absence of the process cartridge or the charging means is determined based on the comparison result. An equivalent circuit 210 is equivalent to the charging roller 8 and the photosensitive drum 7, and its impedance is determined by parameters, such as the resistance of the sponge resistor 8*d*, the thickness of the photosensitive member, and so on. A contact 218 corresponds to the aforementioned charge contact, and a contact 219 corresponds to the aforementioned drum earth contact. When the process cartridge or the charging means is absent or when the process cartridge is incompletely mounted, the charge contact 218 or the drum-earth contact 219 is not connected so that the impedance of this equivalent circuit 210 becomes infinitely large.

In the apparatus with this arrangement, processes for detecting the presence/absence of the process cartridge or the charging means will be explained below.

As described above, the charging roller 8 is impressed with a voltage waveform obtained by superposing a predetermined DC-offset voltage on an AC voltage with a predetermined cycle, as shown in FIG. 15. The voltage amplitude of the AC component of this waveform is determined as follows.

The half-wave rectifying circuit 205 detects the output current of the high-voltage converting circuit 202, and outputs the detected current to the differential amplifier 206. The differential amplifier 206 amplifies the difference between the output value of the half-wave rectifying circuit 205 and the reference voltage 207, and outputs the difference to the variable gain amplifier 201. The variable gain amplifier 201 outputs an AC voltage, which has a cycle of the reference-voltage generating circuit 200 and an amplitude proportional to the output from the differential amplifier 206. The high-voltage converting circuit 202 outputs an AC voltage proportional to the AC voltage output from the variable gain amplifier 201. The route of the variable gain amplifier 201, the high-voltage converting circuit 202, the electric current rectifying resistance 204, the half-wave rectifying circuit 205, and the differential amplifier 206 forms a negative feedback loop, and as a consequence, the output voltage from the half-wave rectifying circuit 205 matches the reference voltage 207. Since the output from the half-wave rectifying circuit 205 detects the output current of the high-voltage converting circuit 202, the AC output current of the high-voltage converting circuit 202 becomes a constant current.

As described above, the AC voltage amplitude impressed to the charging roller 8 is controlled so that an electric current that flows through the impedance expressed by the equivalent circuit 210 becomes constant.

To restate, the waveform obtained by superposing a DC offset of a constant voltage on an AC high voltage of the constant current is impressed to the charging roller 8. Impression of such waveform to the charging roller 8 is a known technique, and can uniformly charge the surface of the photosensitive member.

Since the output from the differential amplifier 206 is proportional to the amplitude of the AC voltage output from the high-voltage converting circuit 202, the amplitude of the AC high voltage impressed to the charging roller 8 can be detected by detecting the output from the differential amplifier 206.

When the process cartridge or the charging means is absent or when the process cartridge is not completely mounted, since the charge contact 218 and the drum-earth contact 219 are not connected, the impedance of this equivalent circuit 210 becomes infinitely large. Since the maximum voltage that the high-voltage converting circuit 202 can output is limited to a predetermined value, hardly any primary AC current flows at that time. For this reason, the output voltage from the half-wave rectifying circuit 205 becomes nearly zero. Hence, the output from the differential amplifier 206 increases up to its maximum value and saturates.

The impedance of the equivalent circuit 210 varies depending on variations of the resistance of the sponge resistor 8*d,* the thickness of the photosensitive member, and the like. The output reference voltage 209 is set to be higher than the voltage output from the differential amplifier 206 when the impedance is maximum.

Hence, when the process cartridge or the charging means is absent or when the process cartridge is not completely mounted, since the impedance of the equivalent circuit 210 becomes infinitely large and the output voltage from the differential amplifier 206 becomes higher than the reference voltage 209, the output from the comparator 208 is inverted.

With the aforementioned arrangement and the operation, by detecting the output from the comparator 208, whether or not the process cartridge B is mounted can be detected. Since circuit components other than the comparator are indispensable in the charging means, only an increase in cost for the comparator is required.

Since the earth contact is located on one end of the process cartridge B in the longitudinal direction of the process cartridge B and the electrode contract of the charging means is located on the other end thereof, malfunctions due to a mounting failure of the process cartridge B on the image forming apparatus A can be prevented more reliably than a layout in which these two contacts are located at neighboring positions.

The aforementioned embodiment is directed to an electrophotographic image forming apparatus onto which a process cartridge is detachably mountable, and forms an image on a recording medium, comprising: (a) a motor; (b) a rotary member that is rotated by the motor and has a coupling portion for driving the process cartridge and an earth contact on its rotation axis; (c) a mounting means for detachably mounting the process cartridge, which has a photoelectric photosensitive member, charging means for charging the photoelectric photosensitive member, a charge contact for receiving a charge voltage supplied from a high-voltage power supply in a main body of the image forming apparatus to the charging means, a coupling portion coaxially coupled to the coupling portion of the rotary member, and an earth contact connected to the earth contact in the photoelectric photosensitive member; (d) a main-body charge contact connected to the charge contact of the process cartridge when the process cartridge is mounted; (e) a main-body earth contact connected to the earth contact of the process cartridge when the process cartridge is mounted; (f) a process-cartridge-mounting-state detecting means for detecting that the process cartridge is mounted when the charge contact and the earth contact of the process cartridge are respectively connected to those of the main body of the apparatus, and for detecting that the process cartridge is not mounted or its mounting failure when one of these contacts is not connected; and (g) conveying means for conveying the recording medium.

According to the aforementioned embodiment, since the apparatus comprises the process-cartridge-mounting state detecting means for detecting that the process cartridge is mounted when the charge contact and the earth contact of the process cartridge are respectively connected to those of the main body of the apparatus, and for detecting that the process cartridge is not mounted or its mounting failure when one of these contacts is not connected, whether or not the process cartridge is surely mounted on the main body of the image forming apparatus can be confirmed.

When the earth contacts and the charge contacts are connected to each other by coupling the coupling portions of the electrophotographic photosensitive drum and the rotary member, the coupling-portion position of the electrophotographic photosensitive drum is determined, and the posture of the process cartridge about the coupling portion is determined when the charge contacts are connected. When it is confirmed that both the contacts are connected, the process cartridge is surely mounted on the main body of the image forming apparatus.

The coupling portions of the rotary member and the electrophotographic photosensitive member have an automatic centering function, which adjusts the earth-contact position to a required position. More preferably, the earth contacts are located at the centers of the twisted hole having a polygonal cross-section and the twisted-polygonal prism.

Since the detecting means comprises an AC high-voltage amplifying circuit for supplying a high-voltage alternate current to the charging means, an AC-electric-current detecting circuit for detecting an AC-electric-current output from the AC high-voltage amplifying circuit, a differential-voltage amplifier for amplifying a differential voltage between the output voltage from the AC-electric-current detecting circuit and a first reference voltage, a variable amplitude generator for changing the waveform amplitude of an AC output voltage in correspondence with the output voltage from the differential-voltage amplifier and inputting the AC output voltage to the AC high-voltage amplifying circuit, and a comparator for comparing the output voltage from the AC-electric-current detecting circuit and a second reference voltage, the mounting state of the process cartridge to the main body of the image forming apparatus can be confirmed, and regular charging is done when the process cartridge is surely mounted on the main body of the image forming apparatus.

The image forming apparatus has a main-body earth contact connected to a drum-earth contact, which is located on one end of the process cartridge in the longitudinal direction of the process cartridge, and a main-body charge contact, connected to a charge contact which is located on the other end of the process cartridge. The charge and the earth contacts are nearly parallel to the electrophotographic photosensitive drum, and are located at nearly farthest positions of the process cartridge in its longitudinal direction. This structure can improve detection precision of mounting of the process cartridge on the main body of the image forming apparatus.

A process cartridge that allows the main body of the image forming apparatus to detect whether or not the process cartridge is mounted at an accurate position with respect to the main body of the image forming apparatus, can be provided.

The posture state of the process cartridge can be detected with high precision.

The process cartridge has a boss that is fitted into a positioning recessed portion of the main body of the image forming apparatus on the axis of the electrophotographic photosensitive drum, and an abutment surface that opposes an abutment member fixed to the main body of the image forming apparatus while the boss is fitted into the positioning recessed portion. The abutment member is used as the charge contact of the main body of the apparatus, and the charge contact of the process cartridge opposes and contacts the abutment member. Connection of the charge contacts can regulate the posture of the process cartridge.

The coupling portions of the electrophotographic photosensitive member and the rotary member have an automatic centering function, and the electrophotographic photosensitive member smoothly rotates, thereby adjusting the earth contact position to a required position.

As described above, according to the present invention, whether the process cartridge is not mounted at a cartridge mounting position can be detected more accurately.

What is claimed is:

1. An electrophotographic image forming apparatus onto which a process cartridge is detachably mountable, for forming an image on a recording medium, comprising:

(a) a mounting member for detachably mounting the process cartridge, the process cartridge having
an electrophotographic photosensitive member,
a charging member for charging said electrophotographic photosensitive member,
a cartridge charge bias contact for receiving a charging bias to be impressed on said charging member from a main body of said apparatus when said process cartridge is mounted on said main body of said apparatus, and
a cartridge earth contact for connecting said electrophotographic photosensitive member to ground with said main body of said apparatus when said process cartridge is mounted on said main body of said apparatus;

(b) a main body charge bias contact to be electrically connected to said cartridge charge bias contact when said process cartridge is mounted on said mounting member;

(c) a main body earth contact to be electrically connected to said cartridge earth contact when said process cartridge is mounted on said mounting member;

(d) a detecting member for detecting that said process cartridge is mounted in a cartridge mounting position by detecting that said cartridge charge bias contact is electrically connected to said main body charge bias contact and that said cartridge earth contact is electrically connected to said main body earth contact; and (e) a conveying member for conveying the recording medium.

2. An apparatus according to claim 1, wherein said main body charge bias contact is located on one end side of the cartridge mounting position provided in said main body of said apparatus, and said main body earth contact is located on the other end side thereof.

3. An apparatus according to claim 1, further comprising a twisted hole having a polygonal cross-section for rotating said electrophotographic photosensitive member, and wherein said hole engages with a twisted-polygonal prism provided on said electrophotographic photosensitive member to transmit a rotational driving force to said electrophotographic photosensitive member.

4. An apparatus according to claim 3, wherein said main body earth contact is located at a center of said twisted hole.

5. An apparatus according to claim 1 or 2, further comprising a twisted-polygonal prism for rotating said electrophotographic photosensitive member, and wherein said polygonal prism engages with a twisted hole having a polygonal cross-section provided in said electrophotographic photosensitive member to transmit a rotational driving force to said electrophotographic photosensitive member.

6. An apparatus according to any one of claims 1, 2, 3, or 4, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

7. An apparatus according to claim 1, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

8. An apparatus according to claim 7, wherein a state that said process cartridge is not mounted in said cartridge mounting position includes a mounting failure of said process cartridge in said cartridge mounting position.

9. An electrophotographic image forming system for forming an image on a recording medium by using a process cartridge which is detachably mountable on a main body of an image forming apparatus, comprising:

(a) a process cartridge having:
an electrophotographic photosensitive member,
a charging member for charging said electrophotographic photosensitive member,
a cartridge charge bias contact for receiving a charging bias to be impressed on said charging member from said main body of said apparatus when said process cartridge is mounted on said main body of said apparatus, and
a cartridge earth contact for connecting said electrophotographic photosensitive member to ground with said main body of said apparatus when said process cartridge is mounted on said main body of said apparatus;

(b) a main body charge bias contact to be electrically connected to said cartridge charge bias contact;

(c) a main body earth contact to be electrically connected to said cartridge earth contact;

(d) a detecting member for detecting that said process cartridge is mounted in a cartridge mounting position by detecting that said cartridge charge bias contact is electrically connected to said main body charge bias contact and that said cartridge earth contact is electrically connected to said main body earth contact; and (e) a conveying member for conveying the recoding medium.

10. A system according to claim 9, wherein said main body charge bias contact is located on one end side of the cartridge mounting position provided in said main body of said apparatus, and said main body earth contact is located on the other end side thereof.

11. A system according to claim 9, further comprising a twisted hole having a polygonal cross-section for rotating said electrophotographic photosensitive member, and wherein said hole engages with a twisted-polygonal prism provided on said electrophotographic photosensitive member to transmit a rotational driving force to said electrophotographic photosensitive member.

12. A system according to claim 11, wherein said main body earth contact is located at a center of said twisted hole.

13. A system according to claim 9 or 10, further comprising a twisted-polygonal prism for rotating said electrophotographic photosensitive member, and wherein said polygonal prism engages with a twisted hole having a polygonal cross-section provided in said electrophotographic photosensitive member to transmit a rotational driving force to said electrophotographic photosensitive member.

14. A system according to any one of claims 9, 10, 11, or 12, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

15. A system according to claim 9, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

16. A system according to claim 15, wherein a state that said process cartridge is not mounted in said cartridge mounting position includes a mounting failure of said process cartridge in said cartridge mounting position.

17. A process cartridge which is detachably mountable on a main body of an electrophotographic image forming apparatus, wherein said electrophotographic image forming apparatus has a main body charge bias contact, a main body earth contact, and a detecting member for detecting that said process cartridge is mounted in a cartridge mounting position by detecting that said main body charge bias contact is electrically connected to a cartridge charge bias contact and that said main body earth contact is electrically connected to a cartridge earth contact, said process cartridge comprising:

an electrophotographic photosensitive member;

a charging member for charging said electrophotographic photosensitive member;

said cartridge charge bias contact to be electrically connected to said main body charge bias contact to receive a charging bias to be impressed on said charging member from said main body of said apparatus when said process cartridge is mounted on said main body of said apparatus; and said cartridge earth contact to be electrically connected to said main body earth contact to connect said electrophotographic photosensitive member to ground with said main body of said apparatus when said process cartridge is mounted on said main body of said apparatus, wherein when said cartridge charge bias contact is electrically connected to said main body charge bias contact and when said cartridge earth contact is electrically connected to said main body earth contact, said detecting member detects that said process cartridge is mounted in the cartridge mounting position.

18. A process cartridge according to claim 17, wherein said cartridge charge bias contact is located on one end of said process cartridge in a longitudinal direction of said process cartridge, and said cartridge earth contact is located on the other end thereof.

19. A process cartridge according to claim 17, wherein said electrophotographic photosensitive member has a twisted-polygonal prism on one end thereof, and said polygonal prism engages with a twisted hole having a polygonal cross-section provided in said main body of said apparatus to receive a rotational driving force for rotating said electrophotographic photosensitive member.

20. A process cartridge according to claim 19, wherein said main body earth contact is located at a center of said twisted hole.

21. A process cartridge according to claim 17 or 18, wherein said electrophotographic photosensitive member has a twisted hole having a polygonal cross-section on one end thereof, and said twisted hole engages with a twisted-polygonal prism provided on said main body of said apparatus to receive a rotational driving force for rotating said electrophotographic photosensitive member.

22. A process cartridge according to any one of claims 17, 18, 19, or 20, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

23. A process cartridge according to claim 17, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

24. A process cartridge according to claim 23, wherein a state that said process cartridge is not mounted in said cartridge mounting position includes a mounting failure of said process cartridge in said cartridge mounting position.

25. An electrophotographic image forming apparatus onto which a process cartridge is detachably mountable, for forming an image on a recording medium, comprising:

(a) a mounting member for detachably mounting a process cartridge, said process cartridge having an electrophotographic photosensitive drum, a twisted-polygonal prism for receiving a rotational driving force for driving said electrophotographic photosensitive drum from a main body of said apparatus when said process cartridge is mounted on said main body of said apparatus, said polygonal prism being formed on one end of said electrophotographic photosensitive drum, and being coaxial with said electrophotographic photosensitive drum, a charging member for charging said electrophotographic photosensitive drum, a cartridge charge bias contact for receiving a charging bias to be impressed on said charging member from said main body of said apparatus when said process cartridge is mounted on said main body of said apparatus, and a cartridge earth contact for connecting said electrophotographic photosensitive drum to ground with said main body of said apparatus when said process cartridge is mounted on said main body of said apparatus, said cartridge earth contact being provided on a center of said twisted-polygonal prism;

(b) a main body charge bias contact to be electrically connected to said cartridge charge bias contact when said process cartridge is mounted on said mounting member;

(c) a main body earth contact to be electrically connected to said cartridge earth contact when said process cartridge is mounted on said mounting member, said main body bias contact being located on one end of the cartridge mounting position provided in said main body of said apparatus, and said main body earth contact being located at the other end thereof;

(d) a detecting member for detecting that said process cartridge is mounted in a cartridge mounting position by detecting that said cartridge charge bias contact is electrically connected to said main body charge bias contact and that said cartridge earth contact is electrically connected to said main body earth contact; and (e) a conveying member for conveying the recording medium.

26. An apparatus according to claim 25, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

27. An apparatus according to claim 25, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

28. An apparatus according to claim 27, wherein a state that said process cartridge is not mounted in said cartridge mounting position includes a mounting failure of said process cartridge in said cartridge mounting position.

29. An electrophotographic image forming system for forming an image on a recording medium by using a process cartridge which is detachably mountable on a main body of an image forming apparatus, comprising:

(a) a process cartridge having an electrophotographic photosensitive drum, a twisted-polygonal prism for receiving a rotational driving force for driving said electrophotographic photosensitive drum from said main body of said apparatus when said process cartridge is mounted on said main body of said apparatus, said polygonal prism being formed on one end of said electrophotographic photosensitive drum, and being coaxial with said electrophotographic photosensitive drum, a charging member for charging said electrophotographic photosensitive drum, a cartridge charge bias contact for receiving a charging bias to be impressed on said charging member from said main body of said apparatus when said process cartridge is mounted on said main body of said apparatus, and a cartridge earth contact for connecting said electrophotographic photosensitive drum to ground with said main body of said apparatus when said process cartridge is mounted on said main body of said apparatus, said cartridge earth contact being provided on a center of said twisted-polygonal prism;

(b) a main body charge bias contact to be electrically connected to said cartridge charge bias contact;

(c) a main body earth contact to be electrically connected to said cartridge earth contact, said main body bias contact being located on one end of a cartridge mounting position provided in said main body of said apparatus, and said main body earth contact being located at the other end thereof;

(d) a detecting member for detecting that said process cartridge is mounted in the cartridge mounting position by detecting that said cartridge charge bias contact is electrically connected to said main body charge bias contact and that said cartridge earth contact is electrically connected to said main body earth contact; and (e) a conveying member for conveying the recording medium.

30. A system according to claim 29, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

31. A system according to claim 29, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

32. A system according to claim 31, wherein a state that said process cartridge is not mounted in said cartridge mounting position includes a mounting failure of said process cartridge in said cartridge mounting position.

33. A process cartridge which is detachably mountable on a main body of an electrophotographic image forming apparatus, wherein said electrophotographic image forming apparatus has a main body charge bias contact, a main body earth contact, and a detecting member for detecting that said process cartridge is mounted in a cartridge mounting position by detecting that said main body charge bias contact is electrically connected to a cartridge charge bias contact and that said main body earth contact is electrically connected to a cartridge earth contact, said process cartridge comprising:

an electrophotographic photosensitive drum;

a twisted-polygonal prism for receiving a rotational driving force for driving said electrophotographic photosensitive drum from said main body of said apparatus when said process cartridge is mounted on said main body of said apparatus, said polygonal prism being formed on one end of said electrophotographic photosensitive drum, and being coaxial with said electrophotographic photosensitive drum;

a charging member for charging said electrophotographic photosensitive drum;

said cartridge charge bias contact for receiving a charging bias to be impressed on said charging member from said main body of said apparatus when said process cartridge is mounted on said main body of said apparatus; and said cartridge earth contact for connecting said electrophotographic photosensitive drum to ground with said main body of said apparatus when said process cartridge is mounted on said main body of said apparatus, said cartridge earth contact being provided on a center of said twisted-polygonal prism.

34. A process cartridge according to claim 33, wherein said detecting member comprises an AC-high-voltage amplifying circuit for supplying a high-voltage alternate current to said charging member, an AC electric current detecting circuit for detecting an AC electric current output from said AC high-voltage amplifying circuit, a differential voltage amplifier for amplifying a differential voltage between an output voltage from said AC electric current detecting circuit and a first reference voltage, a variable amplitude generator for changing a waveform amplitude of an AC output voltage in correspondence with an output voltage from said differential voltage amplifier, and inputting the AC output voltage to the AC high-voltage amplifying circuit, and a comparator for comparing the output voltage from said AC electric current detecting circuit and a second reference voltage.

35. A process cartridge according to claim 17 or 33, wherein said process cartridge comprises at least one of a developing member and a cleaning member in addition to said charging member.

36. A process cartridge according to claim 33, wherein said cartridge charge bias contact is located on one end of said process cartridge in a longitudinal direction of said process cartridge, and said cartridge earth contact is located on the other end thereof.

37. A process cartridge according to claim 33, wherein said detecting member detects that said process cartridge is not mounted in said cartridge mounting position by detecting that at least one of electrical connections between said cartridge charge bias contact and said main body charge bias contact and between said cartridge earth contact and said main body earth contact is not established.

38. A process cartridge according to claim 37, wherein a state that said process cartridge is not mounted in said cartridge mounting position includes a mounting failure of said process cartridge in said cartridge mounting position.

* * * * *

UNITED STATES PATENT AND TRADEMARK OFFICE

CERTIFICATE OF CORRECTION

PATENT NO. : 6,201,935 B1
DATED : March 13, 2001
INVENTOR(S) : Ichiro Terada et al.

It is certified that error appears in the above-identified patent and that said Letters Patent is hereby corrected as shown below:

Column 2,
Line 18, “bronze)” should read -- bronze), --.
Line 58, “cartridge” should read -- cartridge- --.
Line 63, “which” should read -- that --.

Column 3,
Line 63, “longitudinal direction means” should read -- term “longitudinal direction” refers to --.
Line 65, “Right or left indicates” should read -- The terms “right” or “left” are to be understood to be relative to --.

Column 4,
Line 23, “detach ably” should read -- detachably --.

Column 5,
Line 60, “which” should read -- that --.

Column 9,
Line 32, “variable amplitude” should read -- variable-amplitude --.
Line 42, “DC-offset voltage” should read -- DC-offset-voltage --.

Signed and Sealed this

Fourth Day of February, 2003

JAMES E. ROGAN
*Director of the United States Patent and Trademark Office*